US008308519B2

(12) United States Patent
Stange

(10) Patent No.: US 8,308,519 B2
(45) Date of Patent: Nov. 13, 2012

(54) METHOD FOR THE PRODUCTION OF A SEALING REGION AND DISCHARGE LAMP PRODUCED BY SAID METHOD

(75) Inventor: Markus Stange, Berlin (DE)

(73) Assignee: Osram AG, Munich (DE)

( * ) Notice: Subject to any disclaimer, the term of this patent is extended or adjusted under 35 U.S.C. 154(b) by 125 days.

(21) Appl. No.: 12/675,402

(22) PCT Filed: Aug. 29, 2007

(86) PCT No.: PCT/EP2007/058953

§ 371 (c)(1),
(2), (4) Date: Feb. 26, 2010

(87) PCT Pub. No.: WO2009/030264

PCT Pub. Date: Mar. 12, 2009

(65) Prior Publication Data

US 2010/0308724 A1 Dec. 9, 2010

(51) Int. Cl.

| | |
|---|---|
| ***H01J 9/20*** | (2006.01) |
| ***H01J 9/40*** | (2006.01) |
| ***H01J 9/32*** | (2006.01) |

(52) U.S. Cl. ..... 445/22; 445/26; 445/27

(58) Field of Classification Search ..... 313/623–625; 445/22, 26–27; 427/58, 111, 126.1, 126.2, 427/419.1

See application file for complete search history.

(56) References Cited

U.S. PATENT DOCUMENTS

| | | | | |
|---|---|---|---|---|
| 2,692,347 | A | 10/1954 | Mason | |
| 3,420,944 | A * | 1/1969 | Holcomb | 313/318.12 |
| 4,749,902 | A | 6/1988 | Weiss | |
| 4,835,439 | A * | 5/1989 | Essock et al. | 313/332 |
| 5,064,395 | A | 11/1991 | Kling et al. | |
| 6,294,870 | B1 * | 9/2001 | Kawashima et al. | 313/623 |
| 6,713,963 | B2 * | 3/2004 | Nakagawa | 313/623 |
| 6,890,236 | B2 * | 5/2005 | Hataoka et al. | 445/26 |
| 7,038,384 | B2 * | 5/2006 | Horiuchi et al. | 313/623 |
| 2004/0256991 | A1 * | 12/2004 | Minamihata et al. | 313/626 |

FOREIGN PATENT DOCUMENTS

| | | | |
|---|---|---|---|
| DE | 642327 | C | 3/1937 |
| DE | 3619068 | A1 | 12/1987 |
| DE | 10200005 | A1 | 7/2003 |
| EP | 0226978 | A2 | 7/1987 |
| EP | 0767968 | B1 | 9/1999 |
| GB | 1485378 | A | 9/1977 |
| JP | 09237610 | A * | 9/1997 |
| WO | 03056607 | A1 | 7/2003 |

OTHER PUBLICATIONS

English language abstract for DE 3619068 A1.
International Search Report of PCT/EP2007/058953 mailed Jul. 16, 2008.
English maschine translation for DE 642327 C.

* cited by examiner

*Primary Examiner* — Mariceli Santiago

(57) ABSTRACT

A method for producing a sealing region, into which an element is fused and which comprises a first sealing region section and a second sealing region section is provided. The method may include applying an encapsulation made of a material onto the element between the production of the first sealing region section and the production of the second sealing region section.

12 Claims, 1 Drawing Sheet

METHOD FOR THE PRODUCTION OF A SEALING REGION AND DISCHARGE LAMP PRODUCED BY SAID METHOD

RELATED APPLICATIONS

The present application is a national stage entry according to 35 U.S.C. §371 of PCT application No. PCT/EP2007/058953 filed on Aug. 29, 2007.

TECHNICAL FIELD

The present invention relates to a method for producing a sealing region, in particular a sealing region of a discharge vessel for discharge lamps, and to a discharge lamp, in particular a high-pressure discharge lamp, having a sealing region thereby produced.

BACKGROUND

The prior art, for example EP 07 679 68, discloses the production of an electrical discharge lamp, in which at least one sealing region arranged on the discharge vessel is produced by forming a first seal and subsequently a second seal, the first seal consisting of a region of the discharge vessel material shrunk on itself and the second seal consisting of a pinch.

The shrunk seal fully encloses a connection between an electrode projecting into the discharge vessel and an electrical feed supplying the electrode with current, while the pinch only extends over the outer region of the electrical feed.

The electrical feed itself is advantageously a metal foil made of molybdenum, which includes a coating in order to minimize oxidation of molybdenum on contact with oxygen.

The production of such a coated molybdenum foil is known, for example, from DE 102 00 005.

A disadvantage with these known discharge lamps, however, is that using coated molybdenum foils entails the risk that the purity of the electrode will be contaminated or the interior of the discharge vessel will be polluted during production.

It is however also possible, as is known from the prior art, to use a foil made in two parts which has a coated side and an uncoated side, the uncoated side being connected to the electrode so as to prevent contamination of the electrode. Such a foil, however, is expensive and time-consuming to produce.

SUMMARY

Various embodiments provide a method for producing a discharge lamp, which on the one hand is economical and on the other hand minimizes the risk of contamination during the production process.

Various embodiments provide a method for producing a sealing region which includes a first sealing region section and a second sealing region section, wherein between the production of the first sealing region section and the production of the second sealing region section, a material encapsulation, in particular a coating, is applied onto an element to be fused into the sealing region, and/or a gas encapsulation is applied onto the element to be fused in.

Advantageously, the interrupted sealing process can ensure that contamination of the electrode or the discharge vessel by the coating material is prevented, since the formation of the first sealing region section tightly seals the discharge vessel and the connection between the electrical feed and the electrode. On the other hand the use of the subsequent coating, and the formation of the second sealing region section which follows this, can reliably prevent molybdenum oxidation processes.

The sealing per se may be carried out by all methods known from the prior art, in particular by local heating by means of a flame, or laser or plasma radiation or by forming a pinch, which methods may also be combined. It is likewise possible to produce the first and second sealing regions by different methods. In the context of this invention, a sealing region is thus intended to mean a region which in the finished lamp is in direct contact with the object to be fused in.

In addition to the coating or instead of the coating, it is furthermore advantageous to introduce a gas which is adapted to react with the electrical feed during the formation of the second sealing region section. Between the formation of the first sealing region section and the formation of the second sealing region section, it may also be advantageous to leave a region which is not fused together and can be filled with a gas having any desired composition.

The interrupted production process of the sealing region furthermore has the advantage that the formation of the second sealing region section is not subject to the same strict requirements as the formation of the first sealing region section. In this way, particularly when the second sealing region section is provided by pinching, processing can be carried out more rapidly and therefore more economically.

BRIEF DESCRIPTION OF THE FIGURES

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

FIG. 1 schematically shows the method steps for producing a sealing region according to the invention in sub-figures A to D.

For the sake of simplicity, since discharge lamps are constructed symmetrically, the figures only show the right-hand side of a discharge vessel with a sealing region and electrical feeds arranged in it. The left-hand side is formed in a similar way.

Figure 1A:
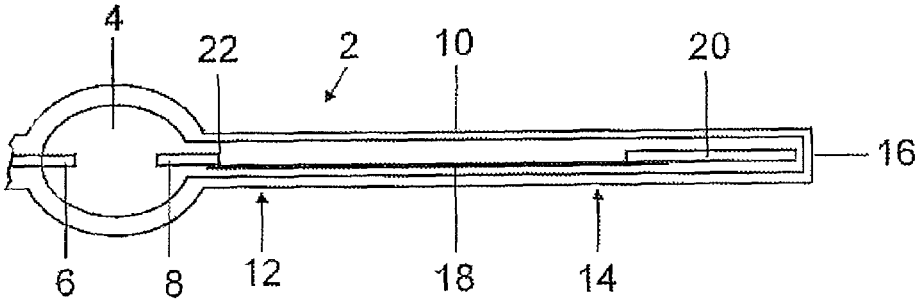
FIGS. 1A-1D show a schematic representation of the production steps according to the invention, the production steps being represented in the sub-figures A to D.

Sub-FIG. 1A shows a discharge vessel 2 having a discharge region 4, into which electrodes 6, 8 project on mutually opposite sides. The discharge vessel is advantageously made of a quartz glass, at least 98 wt % of which consists of $SiO_2$.

FIG. 1A furthermore shows a tubular sealing region 10 which is arranged on the right of the discharge space and, after it has been fused, includes a first sealing region section 12 and a second sealing region section 14, although sealing region sections have not yet been formed in FIG. 1A. FIG. 1A also shows that the discharge vessel 2 has a termination 16 on its right-hand end. The termination may be provided by actual closure of the tubular sealing region. It is, however, also possible for the termination to be formed only indirectly, for example by connection to a valve in a production machine.

Electrical feed elements 18, 20 are introduced into the tubular sealing region 10; the electrical feed element 18 may preferably be formed as a molybdenum foil and the electrical feed element 20 may preferably be formed as a current-carrying pin, which may in turn provide an electrically conductive connection to a cap (not shown here) for discharge lamps.

Owing to the very high melting point of the quartz glass being used, the discharge vessel must be heated to from 2000 to 2500° C. in order to shape it. This limits the materials which can be used for the electrical feeds 18 and 20 and the electrodes 6, 8. Molybdenum is preferably used, although this has the disadvantage that molybdenum is oxidized very strongly by air at temperatures above about 300° C.

In order to protect molybdenum from this strong oxidation, a coating that prevents oxidation should advantageously be applied onto the electrical feed 18. In order to prevent or reduce oxidation, it is particularly advantageous to apply a chromium layer onto the molybdenum foil. Coatings which fulfill other functions are however also possible. Known coatings consist for example of oxides of yttrium, lanthanum, lanthanides, scandium, magnesium, calcium, strontium, barium, zirconium, hafnium, tantalum, titanium, thorium, aluminum, boron or silicon. Such coatings may inter alia increase the adhesive effect when forming a sealing region. Normally, however, these known coatings are applied onto the molybdenum foil before it is installed, and they can therefore cause contamination in the discharge vessel or on the electrodes.

So that neither the electrodes 6, 8 nor the discharge region 4 are contaminated, however, according to the invention an uncoated molybdenum foil is introduced into the tubular sealing region 10.

As represented in FIG. 1A, the discharge space 4 and the tubular sealing region 10 are still in communication with one another, i.e. the first sealing region section has not yet been formed in FIG. 1A. A fill, which is made to luminesce during operation of the discharge lamp by means of electrodes 6 and 8, may advantageously be introduced into this space.

Figure 1B:
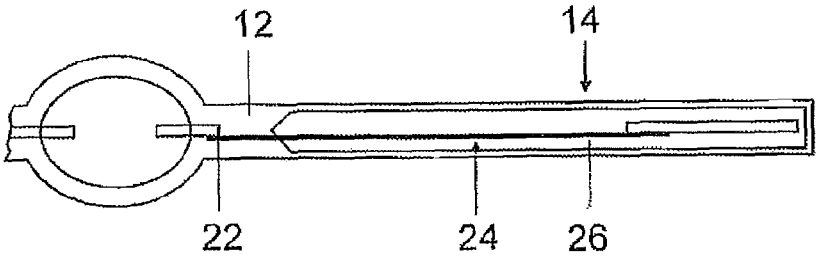

In a first method step, which is shown in sub-FIG. 1B, the discharge region 4 is now closed off by producing the first sealing region section 12 so as to close the connecting space between the discharge region 4 and the tubular sealing region 10. The sealing region section 12 likewise includes a connecting region 22 between the electrode 8 and the electrical feed 18.

The sealing region section 12 is in this case produced for example by locally heating the quartz glass of the discharge vessel 2 around this region by means of flames, or laser or plasma radiation, so that it shrinks together in this heated region. This shrinkage of the heated quartz glass fully closes the discharge region 4 and also encloses the connecting point 22 between the electrode and the molybdenum foil in a vacuum-tight fashion. The first sealing region is furthermore pressure-stable, in order to be able to maintain the pressure prevailing in the discharge vessel 4. Instead of shrinkage, it is naturally also possible to produce the first sealing region by means of other methods, for example by means of pinching.

The shrunk region may cover up to half of the foil. It is however also possible for the first sealing region section 12 to end at a position very close to the discharge space 4. The remaining region of the foil 24, and the current supply pins 20, are not affected by this sealing process and a spatial separation 26 remains between the discharge vessel 2 and the electrical feed elements 18, 20.

Figure 1C:
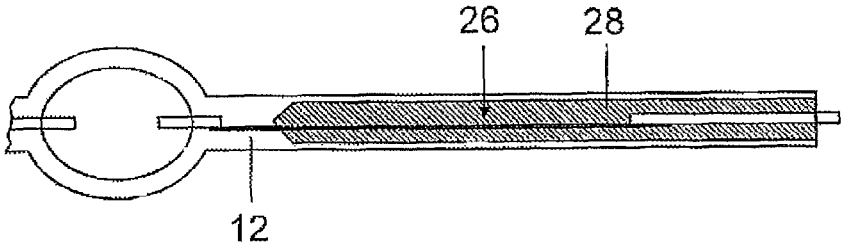

In a method step subsequent to this, which is shown in FIG. 1C, the termination 16 of the discharge vessel 2 is opened and a coating material 28 can be introduced into the space 26 between the electrical feed elements 18, 20 and the discharge vessel 2.

The coating material 28 remains in the space 26 until a layer has been formed on the electrical feed elements 18, 20.

In order to form a chromium layer on the electrical feed elements 18, 20, for example, a chromium solution may be poured into the space 26, the chromium layer being formed by electrochemical deposition of chromium onto the electrical feed elements 18, 20 by connecting up the electrical feed elements 18, 20.

The material not consumed during the coating may subsequently be removed from the space 26.

After or instead of the coating process, a gas may be introduced into the region 26. Such a gas may on the one hand be an ignition gas which assists operation of the discharge lamp, although on the other hand it is also possible to introduce a gas which reactively assists the subsequent sealing step for forming the second sealing region section 14.

Figure 1D:
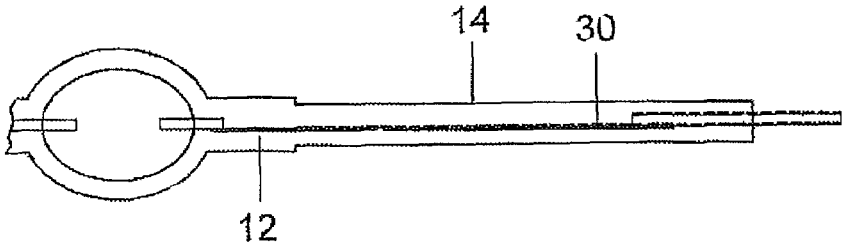

In a further method step, which is represented in sub-FIG. 1D, the second sealing region section 14 is formed by pinching or fusing. The electrical feed elements 18, 20 now have a coating 30 which reliably prevents oxidation of the current supply material being used.

In FIG. 1D, the two sealing region sections 12 and 14 are arranged immediately next to one another. It is however also possible for a spacing, which may contain a gas having any desired composition, to be left between the sealing region sections 12 and 14.

The fusing or pinching process per se may also be carried out under a protective gas.

A method has been disclosed for producing a sealing region of a discharge lamp, the sealing region having a first sealing region section and a second sealing region section, and a further method step being carried out between the production of the first sealing region and the production of the second sealing region.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for producing a sealing region, into which an element is fused and which comprises a first sealing region section and a second sealing region section, the method comprising:

applying an encapsulation made of a material onto the element between the production of the first sealing region section and the production of the second sealing region section, wherein the material encapsulation is a coating.

2. The method as claimed in claim 1, wherein the coating is applied by introducing a coating solution.

3. The method as claimed in claim 1, wherein the coating is applied by electrochemical deposition of a coating material.

4. The method as claimed in claim 1, wherein the material encapsulation comprises a material which reactively assists the formation of the second sealing region section.

5. The method as claimed in claim 1, wherein the first sealing region section is produced by at least one of shrinking the discharge vessel material on itself; pinching;

and fusing.

6. The method as claimed in claim 1, wherein the second sealing region section is produced by at least one of shrinking; pinching: and fusing.

7. The method as claimed in claim 1, wherein the element is an electrical feed, in particular a foil.

8. The method as claimed in claim 1, wherein the element comprises molybdenum.

9. The method as claimed in claim 1, wherein a chromium coating is applied onto the element.

10. The method as claimed in claim, wherein the coating is adapted to provide oxidation protection.

11. The method as claimed in claim 1, wherein the discharge vessel material is quartz glass.

12. The method as claimed in claim 1, wherein the discharge vessel comprises at least one electrode and the element is configured as an electrical feed for this electrode and is connected to the electrode, the first sealing region section fully enclosing the connection between the electrode and the electrical feed.

* * * * *

UNITED STATES PATENT AND TRADEMARK OFFICE

CERTIFICATE OF CORRECTION

PATENT NO. : 8,308,519 B2
APPLICATION NO. : 12/675402
DATED : November 13, 2012
INVENTOR(S) : Markus Stange It is certified that error appears in the above-identified patent and that said Letters Patent is hereby corrected as shown below:

- in the Specification please correct line 12 to read as follows:
  "to 2500° C in order to shape it."

- in claim 10 please correct line 5 to read as follows:
  "The method as claimed in claim 1,"

Signed and Sealed this
Fifth Day of February, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,308,519 B2
APPLICATION NO. : 12/675402
DATED : November 13, 2012
INVENTOR(S) : Markus Stange It is certified that error appears in the above-identified patent and that said Letters Patent is hereby corrected as shown below:

- in the Specification please correct column 3, line 12 to read as follows:
  "to 2500° C in order to shape it."

- please correct column 6, line 5 (Claim 10, line 1) to read as follows:
  "The method as claimed in claim 1,"

This certificate supersedes the Certificate of Correction issued February 5, 2013.

Signed and Sealed this
Nineteenth Day of March, 2013

Teresa Stanek Rea
*Acting Director of the United States Patent and Trademark Office*